US005697188A

United States Patent [19]

Fullick et al.

[11] Patent Number: 5,697,188

[45] Date of Patent: Dec. 16, 1997

[54] WINDOW SASH BALANCE SHOE WITH FRICTION ADJUST MECHANISM

[75] Inventors: Ken Fullick, 6810 Rhode Island Trail, Crystal Lake, Ill. 60012; Teodor Urdea, McHenry, Ill.

[73] Assignee: Ken Fullick, Crystal Lake, Ill.

[21] Appl. No.: 569,492

[22] Filed: Dec. 8, 1995

[51] Int. Cl.[6] ..... E05D 15/21

[52] U.S. Cl. ..... 49/181; 49/176

[58] Field of Search ..... 49/176, 181, 161, 49/445, 447

[56] References Cited

U.S. PATENT DOCUMENTS

| | | | |
|---|---|---|---|
| 3,055,063 | 9/1962 | Peters . | |
| 3,184,784 | 5/1965 | Peters . | |
| 3,482,354 | 12/1969 | Trout . | |
| 4,363,190 | 12/1982 | Anderson | 49/181 |
| 4,364,199 | 12/1982 | Johnson et al. . | |
| 4,517,766 | 5/1985 | Haltof . | |
| 4,570,382 | 2/1986 | Suess . | |
| 4,571,887 | 2/1986 | Haltof . | |
| 4,654,928 | 4/1987 | Flight . | |
| 4,672,713 | 6/1987 | Newton et al. . | |
| 4,683,676 | 8/1987 | Sterner, Jr. | 49/176 |
| 4,685,175 | 8/1987 | Yonovich . | |
| 4,718,194 | 1/1988 | FitzGibbon et al. | 49/181 |
| 4,763,445 | 8/1988 | Silverman . | |
| 4,813,180 | 3/1989 | Scalzi . | |
| 4,958,462 | 9/1990 | Cross . | |
| 5,069,001 | 12/1991 | Makarowski . | |
| 5,127,192 | 7/1992 | Cross . | |
| 5,210,976 | 5/1993 | Cripps | 49/181 |
| 5,237,775 | 8/1993 | Hardy . | |
| 5,243,783 | 9/1993 | Schmidt et al. . | |
| 5,371,971 | 12/1994 | Prete . | |
| 5,414,960 | 5/1995 | O'Donnell et al. | 49/181 |

*Primary Examiner*—Kenneth J. Dorner
*Assistant Examiner*—Curtis A. Cohen
*Attorney, Agent, or Firm*—Ladas & Parry

[57] ABSTRACT

A window sash balance shoe for use in a tiltable window assembly. The window sash balance shoe is capable of adjusting the frictional force between a window sash and the walls of a guide track sufficient to allow said window sash balance shoe to maintain its vertical position in the guide tracks along the range of vertical positions, but insufficient to prevent the window sash balance shoe from being raised or lowered. The window sash balance shoe has a body having a transverse bore within which a friction adjustment cam resides. As the friction adjust cam is rotated it causes the body to expand within the guide tracks. The window sash balance shoe additionally provides a connector for receiving a pivot bar of a window sash and a connector for receiving a tension device or spring. The connector for receiving a tension device is a hook having a notch formed in the convex side of the hook. The notch provides a point at which the end of the tension device can stretch over the hook and rest within the notch.

17 Claims, 4 Drawing Sheets

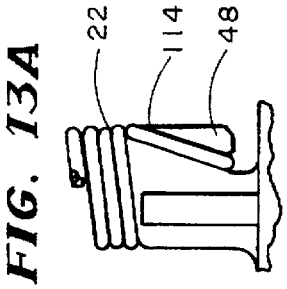
FIG. 13A
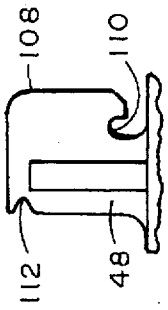
FIG. 13
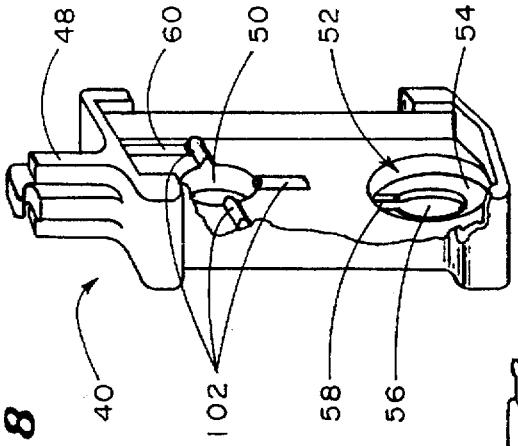
FIG. 8
FIG. 11
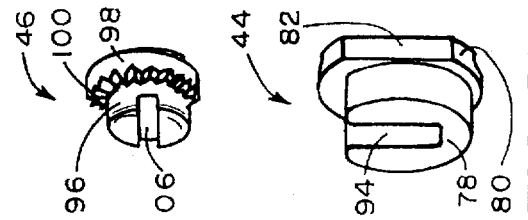
FIG. 12
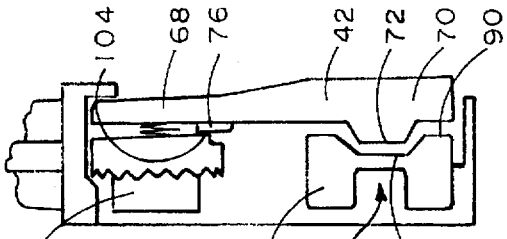
FIG. 10C
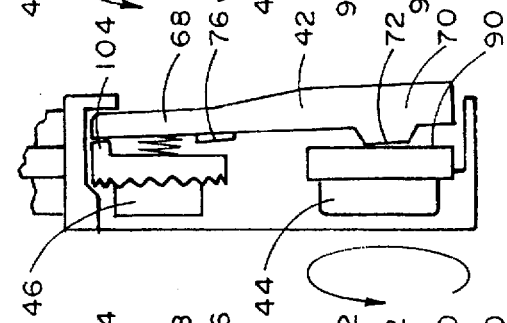
FIG. 10B
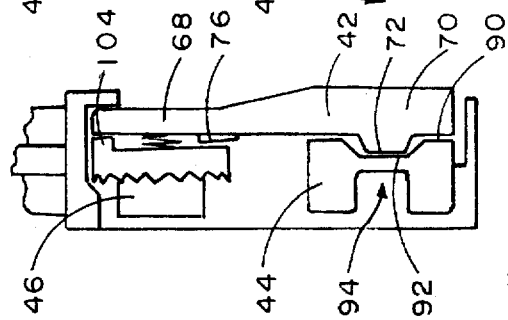
FIG. 10A
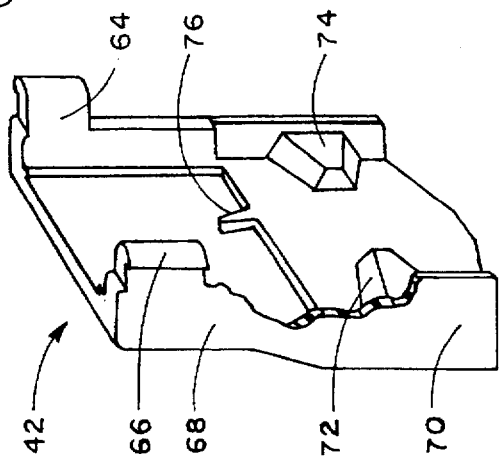
FIG. 9

WINDOW SASH BALANCE SHOE WITH FRICTION ADJUST MECHANISM

BACKGROUND OF THE INVENTION

1. Field of the Invention

The present invention relates to a window sash balance shoe, for traveling within a guide track of a tiltable window assembly, having a mechanism for adjusting the frictional force between the window sash balance shoe and the walls of the guide track.

2. Description of the related art including information disclosed under 37 CFR §§ 1.97–1.99.

Heretofore, various apparatus for adjusting the frictional force between a window sash and the walls of a guide track have been proposed. Several examples of analogous and non-analogous friction adjustable window sash devices are disclosed in the following U.S. Patents:

| U.S. Pat. No. | Patentee |
|---|---|
| 4,517,766 | Haltof |
| 4,571,887 | Haltof |
| 4,654,928 | Flight |

The Haltof, U.S. Pat. No. 4,517,766 discloses a sash holder for running in a jamb liner having a pair of parallel edge guides that are L-shaped in cross section. The sash holder has a pair of runners whose lateral edges are trapped under the L-shaped guides. The sash holder additionally has a friction shoe which is variably pressed against a surface of the jamb liner by an adjustment screw. By adjusting the screw the friction shoe provides more or less friction with respect to the jamb liner and edge guides, dependant on the direction of adjustment.

The Haltof, U.S. Pat. No. 4,571,887 discloses a sash holder for running in a jamb liner having a pair of parallel edge guides that are L-shaped in cross section. The sash holder includes an upper component and a lower component with the two components overlapping one another. The lower component is attached to the window sash, while the upper component is attached to one end of a spring with the other end of the spring attached to the top of the window frame. The two components overlap in such a way that the stronger the force pulling the two components apart the more friction the sash holder will generate within the jamb liner. The amount of force pulling the two components is a function of the strength of the spring and the weight of the window sash.

The Flight, U.S. Pat. No. 4,654,928 discloses a block and tackle window sash balance system using a U-shaped friction spring straddling a pulley. One side of the U-shaped spring is attached to the support bracket. The other end of the U-shaped spring rides against a face of the pulley. A cam is positioned between the U-shaped spring such that when the cam makes a quarter turn the spring legs are spread apart removing the friction against the pulley from the U-shaped spring allowing the pulley to turn freely.

SUMMARY OF THE INVENTION

According to the present invention there is provided a window sash balance shoe for traveling within a guide track of a tiltable window system a mechanism for adjusting the frictional force between the window sash balance shoe and the walls of the guide track.

The window sash balance shoe comprises a body having a transverse bore, a friction adjust cam located within the transverse bore, a hook for connecting a tension device like a spring, and mechanism for receiving a pivot bar attached to the bottom of the window sash.

The hook for attaching a tensioning device or spring has a convex side and a concave side. A first groove for attaching the end of a spring is located on the concave side. A second grove for receiving the first coil of a spring is located on the convex side.

The friction adjust cam rotates within the transverse bore. As the friction adjust cam rotates it gradually pushes against the body of the window sash balance shoe causing the body of the window sash balance shoe to expand an incrementally varying amount. As the window sash balance shoe expands the degree of friction between the window sash balance shoe and the guide track, within which the window sash balance shoe travels, gradually increases.

Friction between the guide track and the window sash balance shoe is very important, because it allows the window sash to maintain a vertical position at various points including the point where the window is closed, the point where the window is open, and all the points in between. Without friction between the window sash balance shoe and the guide track, the window sash would maintain a single position at a point where the force from the weight of the window sash balances the force from the spring or tension device attached to the window sash balance shoe.

The tension device, typically a spring, has one end which is attached to the window sash balance shoe. The other end of the tension device is attached at the top of the window assembly. The tension device at all points of travel for the window sash, between fully open and closed, is in a stretched condition such that it provides a force in an upward direction towards the top of the window assembly. The force exerted by most tension devices, including a spring, is dependant on the distance the tension device is stretched. The greater the distance the tension device is stretched the greater the force exerted by the tension device to attempt to return the tension device to an unstretched condition.

When the window sash is in a closed position the tension device is stretched to its largest amount. When the window sash is in a fully opened position the tension device is stretched its least amount. Consequently the force exerted in an upward direction will be greatest when the window is closed, gradually diminishing as the window sash is opened to its fully opened position.

Gravity acts on the mass of the window sash exerting a force in a downward direction. While the force exerted by the tension device is dependant on the position of the window sash within the window assembly, the force of gravity exerted on the window sash remains substantially constant as the window sash travels through its range of possible positions.

Ideally the window assembly will be constructed such that the forces exerted on the window sash from the tension device and gravity will balance when the window is partially open. As the window is closed from the partially open position, the tension device is caused to stretch further increasing the amount of force exerted by the tension device. Conversely as the window is opened further from the partially open position, the tension device moves closer to its unstretched position decreasing the amount of force exerted by the tension device.

In the absence of friction between the window sash balance shoe and the guide track, the unequal forces would cause the window sash to move within the window assembly back to a point where the forces were equal or balanced.

However with friction, as long as the difference in forces between the force of gravity on the window sash and the force exerted by the tension device does not exceed the force of friction between the window sash balance shoe and the guide track, the window will maintain its vertical position.

While not enough friction between the window sash balance shoe and the guide tracks will not allow the window sash to maintain its vertical position over its full range of travel, too much friction between the window sash balance shoe can make it difficult to open or close the window sash. Therefore, the amount of friction should be just enough for a window sash to maintain its vertical position over its full range of travel.

Because of inherent tolerances in any manufactured product, for example a guide track that might be slightly wider or narrower due to inconsistencies in manufacture, and intentional tolerances in product design, for example to account for expansion and contraction of materials in different operating environments due to differences in temperature or humidity, it is very difficult to design a non-adjustable window sash balance shoe that can provide an optimum amount of friction in each window frame. Therefore a window sash balance shoe that allows the amount of friction to be variably adjusted would be very beneficial. It would also allow the same window sash balance shoe to be used in an environment where different strength tension devices and different weight window sashes were being used.

Other objects and advantages of the present application will be apparent from the detailed description and drawings which follow.

BRIEF DESCRIPTION OF THE DRAWINGS

FIG. 8 is a perspective view of a front piece of the body of the window sash balance shoe.

FIG. 9 is a perspective view of a back piece of the body of the window sash balance shoe.

FIG. 10A is a side sectional view of the window sash balance shoe with the back piece of the body in a non-deflected position.

FIG. 10 a side sectional view of the window sash balance shoe with the back piece of the body deflected as a result of the tilt-locking cam being rotated 90°.

FIG. 10C is a side sectional view of the window sash balance shoe with the back piece of the body deflected as a result of the friction adjust cam being rotated.

FIG. 11 is a perspective view of the friction adjust cam.

FIG. 12 is a perspective view of the tilt-locking cam.

FIG. 13 is an enlarged plan view of a hook for connecting a tension device or spring.

FIG. 13A is an enlarged plan view of the hook shown in FIG. 13 with a spring attached.

DESCRIPTION OF THE PREFERRED EMBODIMENT

Figure 1:
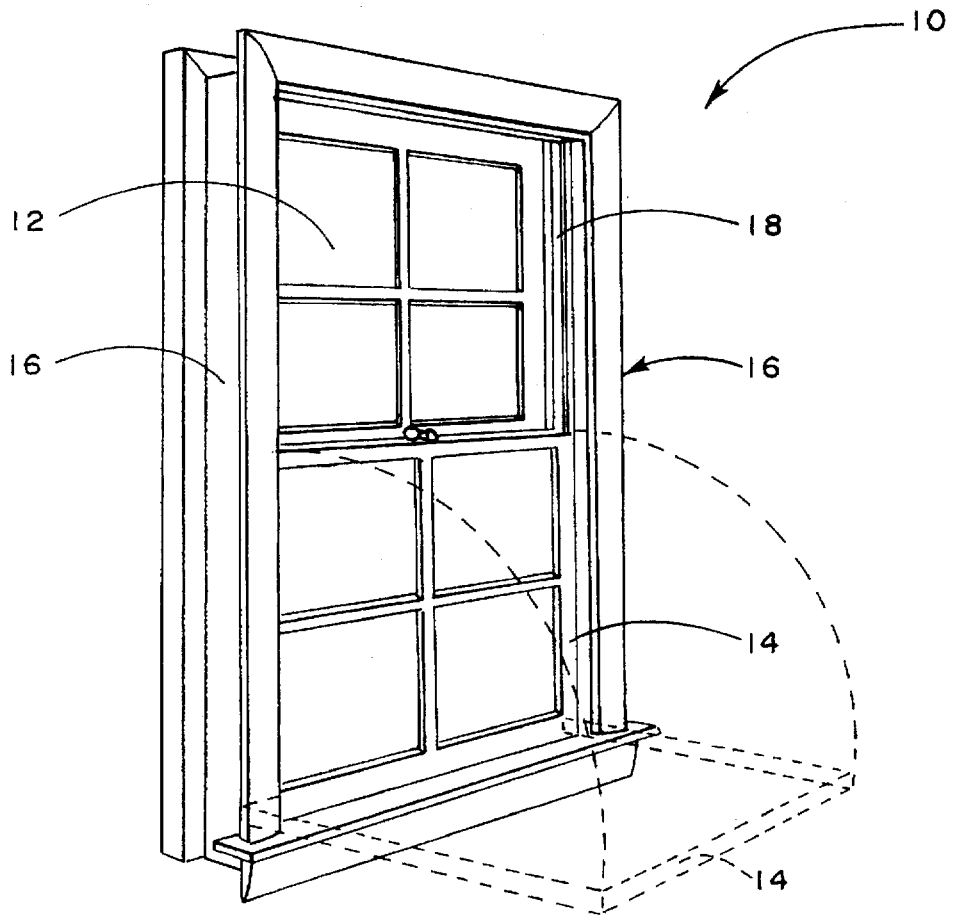
FIG. 1 is a perspective view of a tiltable sash window.

Referring now to the drawings in greater detail, there is illustrated in FIG. 1 a perspective view of a tiltable sash window system 10. The window sash system 10 has an upper outer window sash 12 and a lower inner window sash 14 which fit within two oppositely placed side jambs 16. Located within each of the two side jambs 16 is at least one guide track/counter weight channel 18. Within each guide track 18 is located a window sash balance shoe 20 and a tensioning device or spring 22, as shown in FIGS. 3 and 4.

Figure 2:
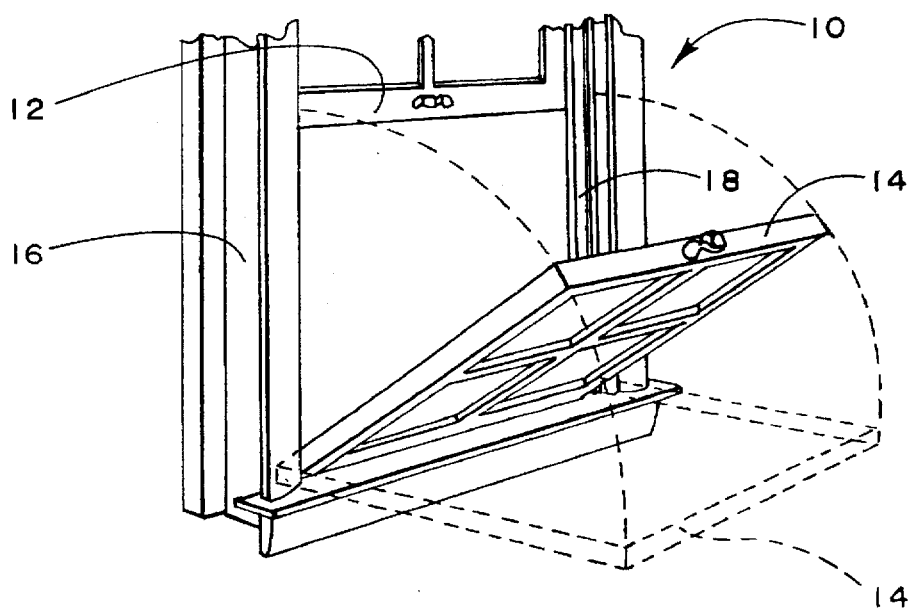
FIG. 2 is a perspective view of the tiltable sash window shown in FIG. 1, with portion broken away and showing the lower sash being tilted out of the window frame.
Figure 3:
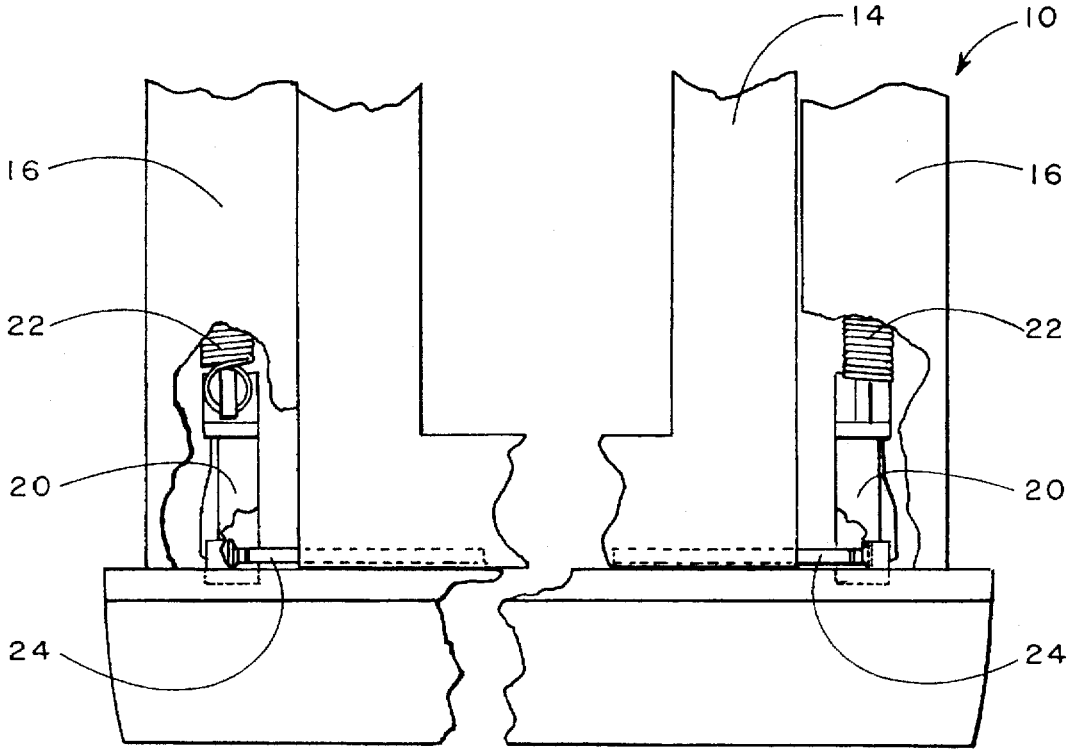
FIG. 3 is a front elevational view of the tiltable sash window shown in both FIG. 1 and FIG. 2, with the front bottom portions of the window frame being cut away to show the window sash balance shoe located in vertically aligned guide tracks.
Figure 5:
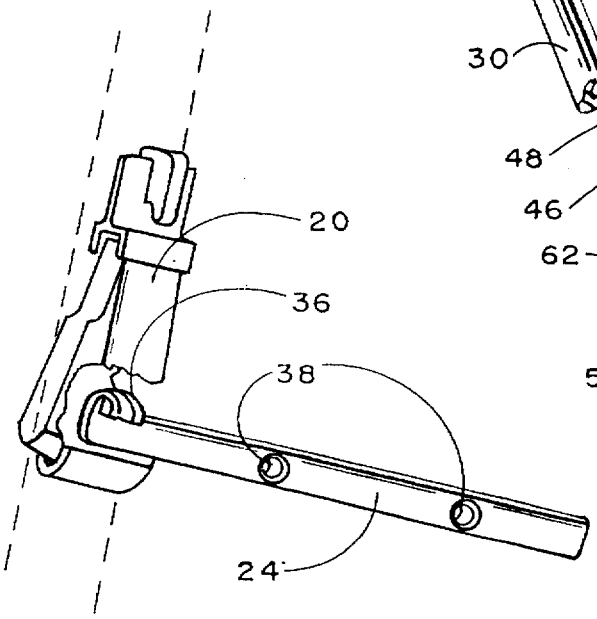
FIG. 5 is a perspective view with cut away of a window sash balance shoe receiving a tilt pivot bar.

The window sashes 12 and 14 are connected to their corresponding window sash balance shoes via a pivot bar shown in both FIGS. 3 and 5, which is attached to the bottom of the window sashes 12 and 14. The pivot bar 24 allows the window sash 12 and 14 to pivot between a vertical and a horizontal position as shown in FIGS. 1 and 2.

FIG. 3 shows a plan view of the tiltable sash window system 10 with portions cut away. The portions of the side jamb 16 are cut away to show the window sash balance shoe 20 located within the guide track 18 connected to both the pivot bar 24 and the tensioning device or spring 22. The other end of the tensioning device or spring 22 is attached to the top of the window assembly within the guide track 18, not shown.

Figure 4:
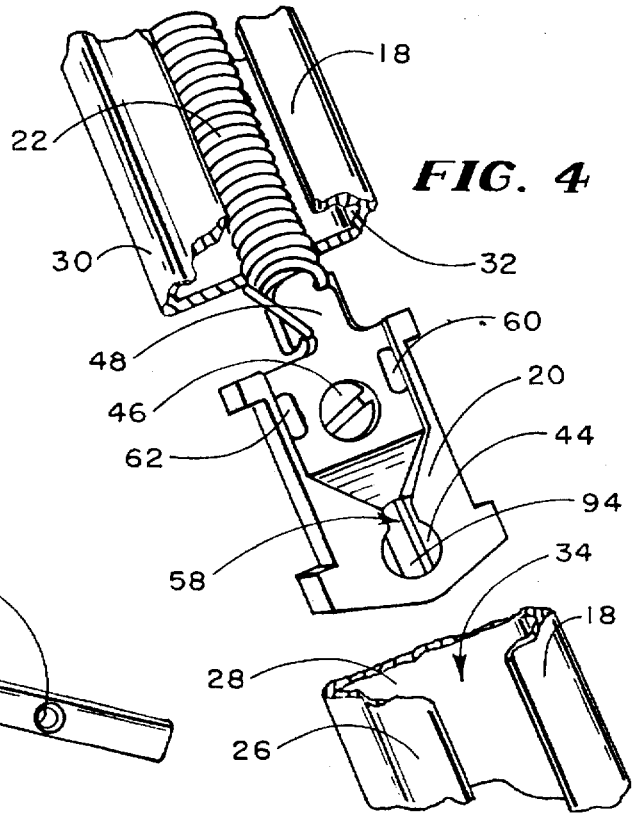
FIG. 4 is an enlarged partial perspective view of a guide track with a portion cut away to show a window sash balance shoe connected to a spring.

FIG. 4 shows an enlarged perspective view of a guide track with a portion cut away to show a window sash balance shoe connected to a spring. The guide track is essentially rectangular in shape. The guide track has opposing front wall 26 and back wall 28. The guide track additionally has two opposing side walls 30 and 32. The front wall 26 has an opening 34 which extends the length of the guide track. The opening 34 provides access to the front of the window sash balance shoe, as well as providing a channel through which the pivot bar can move as the window sash 12 or 14 in a vertical position is raised or lowered.

FIG. 5 shows a perspective view with cut away of a window sash balance shoe 20 receiving a tilt pivot bar 24. The preferred embodiment receives an "L"-shaped end 36 with cross bar 37 of the pivot bar 24. The pivot bar 24 additionally has two holes 38 located along the long leg of the "L". The two holes 38 are used for attaching the pivot bar 24 to the bottom of the window sash 12 or 14.

Figure 6:
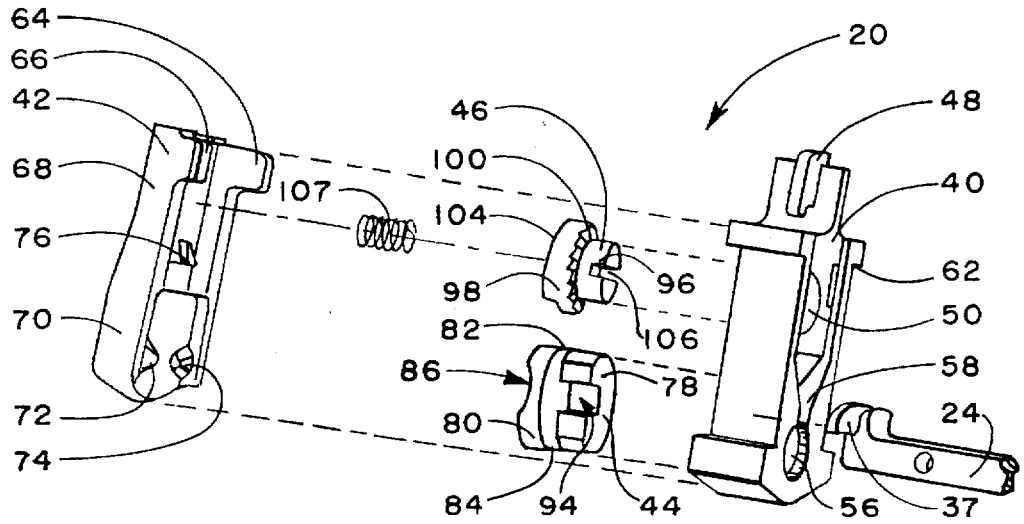
FIG. 6 is an exploded perspective view of a window sash balance shoe.
Figure 7:
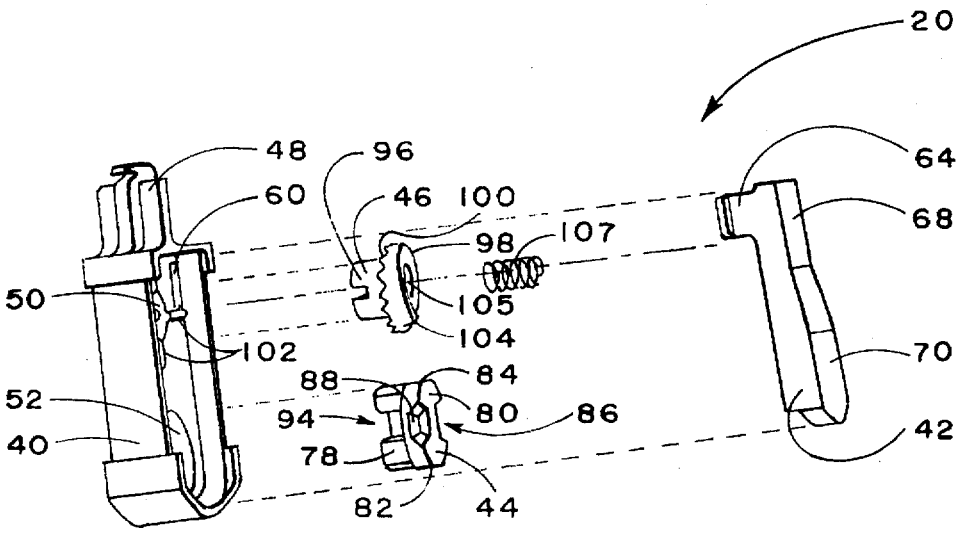
FIG. 7 is a second exploded perspective view of a window sash balance shoe.

FIGS. 6 and 7 show exploded perspective views of the preferred embodiment of window sash balance shoe with friction adjust mechanism. The window sash balance shoe 20 comprises four elements; a body having a front piece 40 and a back piece 42, a tilt locking cam 44, and a friction adjust cam 46.

The front piece 40 of the body, also shown in FIG. 8, is generally rectangular in shape having an open back side. The front piece 40 of the body has a hook 48 for receiving a tensioning device or spring 22 integrally connected to the front piece 40 of the body. The hook will be discribed in greater detail with respect to FIGS. 13 and 13A.

The front piece 40 additionally has two transverse bores 50 and 52. The first transverse bore 50 extends all the way through the front piece 40 near the top of the front piece 40. The first transverse bore 50 is sized and shaped to receive the friction adjust cam 46. The second transverse bore 52 extends from the back of the front piece 40 of the body into the front piece 40 a fractional amount. The second transverse bore 52 is located near the bottom of the front piece 40. The second transverse bore 52 is sized and shaped to receive the tilt locking cam 44.

At the bottom 54 of the second transverse bore 52 is a hole 56 having a smaller diameter than the second transverse bore 52 which extends the rest of the way through the front piece 40 of the body. The hole 56 has the same central axis as the second transverse bore. Extending from the edge of hole 56 to the edge of the second transverse bore 52 is a slot 58, also shown in FIG. 4.

The front piece 40 of the body has two rectangular holes 60 and 62 one on each side of the first transverse bore 50 and both slightly above the first transverse bore 50. Rectangular hole 62 can also be seen in FIG. 4. The rectangular holes are for receiving two prongs 64 and 66 of the back piece 42 of the body.

The back piece 42 of the body, also shown in FIG. 9, is also generally rectangular in shape, but is smaller than the front piece 40. The back piece 42 of the body fits within the open back side of the front piece 40. At the top 68 of the back piece 42 there are two prongs 64 and 66 which extend perpendicular to the back piece 42 toward the front piece 40. The front piece 40 and the back piece 42 are coupled together by the two prongs 64 and 66 of the back piece 42 engaging the two rectangular holes 60 and 62 of the front piece 40. The back piece 42 of the body is coupled to the front piece 40 of the body only at the top 68 of the back piece 42. By coupling the back piece 42 only at the top 68, the bottom 70 of the back piece 42 can deflect away from the front piece 40.

The bottom 70 of the back piece 42 is thicker than the top 68 of the back piece 42. The space between the top 68 and the bottom 70 has a thickness which gradually increases from the thinner top 68 to the thicker bottom 70.

The back piece 42 has three block like protrusions which extend toward the front piece 40 and the two cams 44 and 46 located in the two transverse bores 50 and 52. A first protrusion 72 and a second protrusion 74 are located at the bottom 70 of the back piece 42 and are positioned to come into contact with the tilt locking cam 44. The third protrusion 76 is a narrow protrusion located near the top 68 of the back piece 42 and is positioned to come into contact with the friction adjust cam 46 near the outer circumference. The third protrusion 76 is oriented so as to follow a radius toward the center of the friction adjust cam 46.

The tilt locking cam 44, also shown in FIG. 12, is generally cylindrical in shape. The tilt locking cam 44 has a front side 78 and a back side 80. The front side 78 is sized and shaped to fit within the second transverse bore 52 of the front piece 40 of the body. The back side 80 has a slightly larger diameter than the front side 78 with two opposing edges 82 and 84 of the back side 80 having a flat edge flush with a diameter of the front side 78. The back side 80 additionally has two notches 86 and 88 which correspond to the first protrusion 72 and second protrusion 74 on the back piece 42 of the body. The notches define a first planer surface 90 and a second planer surface 92 on the back side 80 of the tilt locking cam 44, shown in FIGS. 10A, 10B and 10C. The front side 78 has a slot 94 which extends from the center of the front side 78 to the outer edge of the front side 78. The slot 94 of the tilt locking cam 44 corresponds to the slot 58 of the front piece 40.

When the slot 94 of the tilt locking cam 44 and the slot 58 of the front piece 40 are rotationally aligned. The tilt locking cam 44 can receive the "L"-shaped pivot bar 24 with the short leg of the "L"-shaped end 36, pointed up, through the front piece 40 of the body. The "L"-shaped pivot bar 24 with the short leg of the "L"-shaped end 36 is up when the window sash 12 or 14 is in a horizontal position. As the window sash 12 or 14 is moved into a non-horizontal position. The tilt locking cam 44 turns with the "L"-shaped end 36 with cross bar 37 of the pivot bar 24 becoming captivated between the tilt locking cam 44 and the bottom of the second transverse bore 54.

The friction adjust cam 46, also shown in FIG. 11, is generally cylindrical in shape. The friction adjust cam 46 has a front side 96 and a back side 98. The front side 96 is sized and shaped to fit within the first transverse bore 50 of the front piece 40 of the body. The back side 98 has a slightly larger diameter than the front side 96. The back side 98 of the friction adjust cam 46 contacts the front piece 40 of the body at the surface formed by the back side 98 which has a larger diameter than the front side 96. The back side 98 of the friction adjust cam 46 has a sawtooth surface 100 on the portion of the front piece 40 that contacts the front piece 40 of the body.

The sawtooth surface 100 is formed by a surface having multiple valleys and peaks. The sawtooth surface 100 mates with four ridges 102 located on the back of the front piece 40 of the body around the perimeter of the first transverse bore 50 and being spaced approximately 90° apart where the back side 98 of the friction adjust cam 46 comes into contact with the front piece 40 of the body. The mating of the ridges 102 of the front piece 40 with the sawtooth surface 100 of the friction adjust cam 46 provides a ratcheting effect, allowing for manual rotational adjustment of the friction adjust cam 46, but prevents the friction adjust cam 46 from creeping out of adjustment. It is important to note that the ratcheting effect can be similarly produced at any of the common contact surfaces to produce the desired effect.

The back surface of the friction adjust cam 46 has a ramp surface 104. The ramp surface 104 increases in a circular fashion following the outer circumference of the friction adjust cam 46. The ramp surface 104 contacts the back piece 42 of the body at the third protrusion 76 of the back piece 42. Inside the circle formed by the ramp surface 104 is a bore 105.

The front side 96 of the friction adjust cam 46 has a slot 106 which extends the diameter of the front side 96. The slot 106 is exposed through the first traverse bore 52 of the front piece 40 of the body. The slot 106 provides a point at which a tool, like a screwdriver, could be inserted to manually turn the friction adjust cam 46.

A spring 107 has one end which fits inside the bore 105 in the back surface of the friction adjust cam 46. The other end of the spring extends outside of the bore 105 and contacts the back piece 42 of the body. The spring 107 applies sufficient force for the sawtooth surface 100 of the friction adjust cam 46 to maintain contact with the ridges 102 of the front piece 40 of the body.

FIGS. 10A, 10B and 10C show side sectional views of the window sash balance shoe 20.

FIG. 10A shows the window sash balance shoe 20 with the back piece 42 of the body undeflected. The back piece 42 of the body is undeflected when the tilt locking cam is rotationally oriented such that the first protrusion 72 and the second protrusion 74 of the back piece 42 of the body are aligned with notches 86 and 88 of the tilt locking cam 44. The protrusions 72 and 74 are aligned with notches 86 and 88 when the window sash 12 or 14 is in a vertical position.

In this orientation, the first protrusion 72 and the second protrusion 74 of the back piece 42 rest against the second planer surface 92 of the tilt locking cam 44. Additionally the third protrusion 76 of the back piece 42 of the body contacts the ramp surface 104 of the friction adjust cam 46 at the bottom of the ramp.

As shown in FIG. 10B, when the window sash 12 or 14 is tilted out of its vertical position, the protrusions 72 and 74 are forced out of the notches 86 and 88 resting against the first planer surface. The bottom 70 of the back piece 42 is deflected out causing the body of the window sash balance shoe 20 to expand. The back piece 42 is deflected sufficiently to create sufficient friction to lock the window sash balance shoe 20 in place within the guide track 18.

As shown in FIG. 10C, instead of the tilt locking cam 44 turning, the friction adjust cam 46 is rotated causing the protrusion 76 to contact the friction adjust cam 46 at a different point along the ramp surface 104. Similar to the turning of the tilt locking cam 44, the turning of the friction adjust cam 46 causes the bottom 70 of the back piece 42 of the body to deflect out. Contrary to the turning of the tilt locking cam 44, the bottom 70 of the back piece 42 of the body is deflected out in small incrementally varying amounts. The window sash balance shoe 20 is incrementally expanded sufficiently to increase the friction between the window sash balance shoe 20 and the guide track 18, but insufficiently to prevent the window sash balance shoe 20 from travelling within the guide track 18.

This allows the window sash balance shoe 20 to have a manually adjustable frictional force between the window sash balance shoe 20 and the guide track 18.

FIGS. 13 and 13A shows an enlarged plan view of the hook 48 for connecting a tension device or spring 22 with both a spring attached and unattached. The hook 48 has a convex side 108 and a concave side 110. Along the concave side 110 the hook has a notch formed for receiving the first coil of a spring as shown in FIG. 13A. To attach the spring the looped end 114 of the spring 22 is stretched up and over the convex side 108 of the hook 48 into the notch 112. Similarly the looped end 114 of the spring 22 must be stretched back up and over the convex side 108 to unattach the spring 22.

From the foregoing description, it will be apparent that the window sash balance shoe 20 of the present invention has a number of advantages, some of which have been described above and others of which are inherent in the invention. Also it will be understood that modifications can be made to the window sash balance shoe 20 described above without departing from the teachings of the invention.

I claim:

1. A tiltable window system of the type comprising, at least two window sash balance shoes, at least two guide tracks each having at least two walls within which at least one of said window sash balance shoes travels, at least two tension devices, at least one tension device coupled to each of said window sash balance shoes and being capable of exerting a force counter to the force of gravity on said window sash balance shoes, and a window sash having a pivot bar, the improvement residing in said window sash balance shoes, each of said window sash balance shoes comprising:

a body which generally conforms to the cross-sectional shape of the guide tracks and which has a back plate and a first transverse bore;

a tension device connector coupled to said body for coupling at least one of the tension devices;

a pivot bar connector for receiving the pivot bar of the window sash at said window sash balance shoe; and an adjustable friction cam situated in said first transverse bore of said body for adjusting the friction sufficient to allow said window sash balance shoe to maintain its vertical position in the guide tracks along the range of vertical positions, but insufficient to prevent said window sash balance shoe from being raised or lowered; and wherein said adjustable friction cam is coupled to said body of said window sash balance shoe such that, as said adjustable friction cam is rotated, the adjustable friction cam contacts said back plate of said body, and said body of said window sash balance shoe expands and contracts with respect to the walls of the guide tracks thereby affecting the frictional force between said window sash balance shoe and the walls of the guide track.

2. The window sash balance shoe of claim 1, wherein said body has a contact surface and said adjustable friction cam has a contact surface which mates with said contact surface of said body in a plurality of rotational positions, such that said adjustable friction cam is restricted from rotating within said first transverse bore.

3. The window sash balance shoe of claim 2, wherein said contact surface of said adjustable friction cam has a saw-tooth configuration including a plurality of valleys and a plurality of peaks, transverse to the direction of rotation of said adjustable friction cam, and wherein said contact surface of said body has at least one ridge for resting within at least one of said valleys.

4. The window sash balance shoe of claim 3, wherein said contact surface of said body has four ridges spaced approximately 90 degrees apart with respect to the circumference of the adjustable friction cam.

5. The window sash balance shoe of claim 3, further comprising a friction adjust spring located between the friction adjust cam and the body for applying a force to maintain contact between said contact surface of said body and said contact surface of said adjustable friction cam.

6. The window sash balance shoe of claim 1, wherein said back plate has a top and a bottom, and is coupled to said window sash balance shoe only at the top of said back plate such that said body of said window sash balance shoe can expand and contract by the deflection of said bottom of said back plate.

7. The window sash balance shoe of claim 6, wherein said adjustable friction cam has a back surface with a ramp surface which contacts said back plate at various points along said ramp surface, dependant on the rotational orientation of the adjustable friction cam, causing said back plate to deflect a variable amount.

8. The window sash balance shoe of claim 1, wherein said adjustable friction cam has a front surface with a slot for receiving the end of a tool for rotationally adjusting said adjustable friction cam.

9. The window sash balance shoe of claim 1, wherein said body further has a second transverse bore and wherein said pivot bar connector is a tilt locking cam situated in said second transverse bore.

10. The window sash balance shoe of claim 9, wherein said tilt locking cam rotates in relation to the amount that said window sash is tilted, and said tilt locking cam includes a back surface with a first planer surface and a second planer surface of differing heights where said back surface of said tilt locking cam contacts said body of said window sash balance shoe at one of said first and said second planer surfaces dependent on the rotational orientation of said tilt locking cam.

11. The window sash balance shoe of claim 10, wherein when said second planer surface of said tilt locking cam contacts said back plate of said body of said window sash balance shoe, said body of said window sash balance shoe expands with respect to the walls of said guide track sufficiently to prevent vertical movement of said window sash balance shoe within said guide track.

12. The window sash balance shoe of claim 11, wherein said second planer surface of said tilt locking cam contacts said body of said window sash balance shoe when said window sash is tilted into a horizontal position.

13. The window sash balance shoe of claim 9, wherein said tilt locking cam has an axis of rotation, an outer circumference, a front surface and a slot in said front surface extending from said axis of rotation to said outer circumference, where said slot is capable of receiving an "L" shaped pivot bar.

14. The window sash balance shoe of claim 13, wherein said body further includes a front surface and a rear surface, such that when said window sash balance shoe is residing in said guide track said front surface of said body faces said window sash and said rear surface faces away from said window sash; wherein said second transverse bore extends partially through said body from said rear surface so as not to extend through said front surface, said second transverse bore having a bottom defined by the point where said second transverse bore stops; and wherein said body further includes a hole having a diameter smaller than the diameter of said second transverse bore extending from the bottom of said second transverse bore to said front surface of said body for exposing said front surface of said tilt locking cam to said pivot bar of said window sash.

15. The window sash balance shoe of claim 14, wherein said front surface of said body further includes a notch extending from the edge of said hole to the edge of said second transverse bore, where said "L" shaped pivot bar can be received by said tilt locking cam when said slot of said tilt locking cam is rotationally aligned with said notch in said front surface of said body.

16. The window sash balance shoe of claim 15, wherein when said notch of said front surface of said body and said slot of said tilt locking cam are rotationally non-aligned, an "L" shaped pivot bar received by said tilt locking cam is captively held between said tilt locking cam and said bottom of said second transverse bore and is prevented from withdrawing from said window sash balance shoe.

17. The window sash balance shoe of claim 16, wherein said "L" shaped pivot bar includes a cross bar section and is received by said tilt locking cam when said window sash is in a horizontal position.

* * * * *